United States Patent [19]

Achard et al.

[11] Patent Number: 4,707,319

[45] Date of Patent: Nov. 17, 1987

[54] PROCESS FOR PRODUCTION OF YARNS AND FIBERS WITH GOOD PROPERTIES, BASED ON ATACTIC POLYVINYL CHLORIDE

[75] Inventors: Georges Achard, Décines; Gilbert Anouilh, Lyon; Jacques Menault, Charbonnieres-Les-Bains, all of France

[73] Assignee: RHOVYL, Neuilly-sur-Seine, France

[21] Appl. No.: 870,303

[22] Filed: May 23, 1986

Related U.S. Application Data

[60] Continuation of Ser. No. 654,176, Sep. 25, 1984, abandoned, which is a division of Ser. No. 522,746, Aug. 12, 1983, Pat. No. 4,508,778, which is a continuation of Ser. No. 328,522, Dec. 8, 1981, abandoned.

[30] Foreign Application Priority Data

Dec. 8, 1980 [FR] France ..... 80 26046

[51] Int. Cl.[4] ..... D02G 1/00

[52] U.S. Cl. ..... 264/168; 264/205; 264/210.2; 264/210.5; 264/210.8; 264/211.17; 264/235.6; 264/289.6; 264/290.5

[58] Field of Search ..... 264/289.6, 210.8, 235.6, 264/168, 205, 210.2, 210.5, 211.17, 290.5

[56] References Cited

U.S. PATENT DOCUMENTS

| | | | |
|---|---|---|---|
| 2,984,593 | 5/1961 | Iaaksen et al. | 264/235.6 |
| 3,372,219 | 3/1968 | Gord | 264/210.8 |
| 3,380,953 | 4/1968 | Fukushima | 525/123 |
| 3,388,201 | 6/1968 | Mazzolini et al. | 264/210.8 |
| 3,424,833 | 1/1969 | Mazzolini et al. | 264/289.6 |
| 3,444,269 | 5/1969 | Beer | 525/71 |
| 3,490,223 | 1/1970 | Mazzolini et al. | 264/289.6 |
| 3,673,167 | 6/1972 | Ledoux et al. | 525/227 |
| 3,907,954 | 9/1975 | Mansmann et al. | 264/56 |

FOREIGN PATENT DOCUMENTS

| | | | |
|---|---|---|---|
| 0624420 | 4/1962 | Belgium | 264/235.6 |
| 1383845 | 6/1962 | France . | |
| 1289491 | 8/1962 | France . | |
| 1359178 | 2/1963 | France . | |
| 1358641 | 2/1963 | France . | |
| 5365422 | 6/1978 | France . | |

*Primary Examiner*—Jan H. Silbaugh
*Assistant Examiner*—Hubert C. Lorin
*Attorney, Agent, or Firm*—Stevens, Davis, Miller & Mosher

[57] ABSTRACT

Yarns and fibers based on atactic polyvinyl chloride possess a residual shrinkage in boiling water of less than 3%, a modulus of elasticity which is greater than or equal to 2 kN/mm$^2$, an orientation index of the crystalline zones which is greater than or equal to 70%, an orientation index of the mesomorphic zones which is greater than or equal to 8%, and an orientation index of the amorphous zones which is greater than or equal to 5%. They are obtained by spinning and stretching in a known manner, then stabilization under tension at a temperature between 105° and 130° C., in the presence of steam under pressure, for 1 to 3 seconds, and then shrinkage in an aqueous fluid medium at a temperature between 98° and 130° C.

6 Claims, No Drawings

PROCESS FOR PRODUCTION OF YARNS AND FIBERS WITH GOOD PROPERTIES, BASED ON ATACTIC POLYVINYL CHLORIDE

This application is a continuation of application Ser. No. 654,176, filed 9/25/84, now abandoned, which in turn is a divisional application of Ser. No. 522,746, filed 8/12/83, now U.S. Pat. No. 4,508,778, which in turn is a continuation of application Ser. No. 328,522, filed 12/8/81, now abandoned.

The present invention relates to filaments, yarns, fibers, monofilaments and other similar articles made of synthetic material, which consist essentially of atactic polyvinyl chloride and have good mechanical properties, and also to processes for their production.

Fibers based on polyvinyl chloride are valued in the textile filed because of certain particular properties, namely non-flammability, resistance to light, chemical inertness and thermal, electrical and acoustic insulating power. Unfortunately, ordinary polyvinyl chloride prepared in accordance with the most commonly used process (at temperatures in the range from 0° to 80° C.), because this is the least expensive, is a predominantly atactic polymer which is normally non-crystallisable and has a glass transition temperature (Tg) of the order of 65°–85° C. Before shrinkage, the yarns and fibers obtained from this polymer possess adequate mechanical properties for their textile conversion (tensile strength from 1.60 to 2.20 cN/dtex; elongation 25–35%; modulus 4–5 kN/mm$^2$), but the finished articles possess an excessively high shrinkage (which can be as much as 60%). On the other hand, if they are subjected to a shrinking treatment, these yarns and fibers then possess inadequate mechanical properties for certain textile applications (tensile strength 0.98–1.32 cN/dtex; elongation 100–130%; modulus 1.20 kN/mm$^2$ to 1.8 kN/mm$^2$).

For the purpose of improving the properties of fibers based on polyvinyl chloride, new polymers have been developed from vinyl chloride by a technique based on polymerisation carried out at temperatures below 0° and dropping to −60° C. or even lower, in the presence of suitable catalysts which are effective at these low temperatures.

These new polymers of predominantly syndiotactic structure have a glass transition temperature (Tg) which is generally above 90°–100° C. and which gives the resulting yarns and fibers a better heat resistance and substantially improved properties, compared with the textile products derived from ordinary polyvinyl chloride. French Application No. 2,161,084, published on 07.06.1973, illustrates fibers with good mechanical properties, based on this type of polymer. However, a low-temperature polymerisation process of this type is an extremely expensive process which considerably increases the cost of the fibers and makes their industrial-scale production much less advantageous.

It has also been proposed, according to French Pat. No. 1,359,178, to improve fibers and yarns based on polyvinyl chloride (PVC) by mixing ordinary polyvinyl chloride with postchlorinated polyvinyl chloride. This solution to the problem, which indeed makes it possible to obtain yarns and fibers with better mechanical characteristics, is all the more expensive, on an industrial scale, the greater the proportion of post-chlorinated polyvinyl chloride added.

Various other improvements of greater or lesser complexity have been investigated by experiment: for example, French Pat. No. 1,333,845 recommends the introduction, into the spinning solution, of a small amount of an non-volatile solvent having a boiling point above that of the solvent or solvent mixture used for spinning ordinary polyvinyl chloride, and this makes it possible to raise the stabilisation temperature of the stretched filaments and to obtain an improved tensile strength. However, on an industrial scale, a process of this type, which furthermore is a batch process, presents the problem of the recovery of the solvent, in both practical and economic terms.

French Patent No. 1,358,641 teaches polyvinylchloride compositions resulting from mixing 2–95% of polyvinylchloride obtained at a temperature higher than 40° C. and 98–5% of polyvinylchloride prepared by polymerization at a temperature lower than 0° C. It also teaches filaments obtained from such mixtures but without any indication about the characteristics of such filaments.

Japanese Application No. 53-65422 teaches a process for the preparation of polyvinylchloride by dry spinning of compositions of polyvinylchloride and post-chlorinated polyvinylchloride, and drawing and heat treating under tension or under limited shrinkage conditions at a temperature of 110°–140° C. allowing a shrinkage of 5–15% (for example in glycerol for 1–6 minutes).

It has now been found that it is possible to obtain, on an industrial scale, continuously, and without chemical modification of the polymer and without the addition of a modifier, yarns and fibers based on predominantly atactic polyvinyl chloride which have mechanical properties similar to those fibers modified by the addition of post-chlorinated polyvinyl chloride.

The present invention relates to filaments, yarns and fibers based on predominantly atactic polyvinyl chloride, which possess a modulus of elasticity which is greater than or equal to 2 kN/mm$^2$, a residual shrinkage in boiling water of less than 3%, an orientation index of the crystalline zones which is greater than or equal to 70%, an orientation index of the mesomorphic zones which is greater than or equal to 8%, and an orientation index of the amorphous zones which is greater than or equal to 5%.

In general, the modulus of elasticity is between 2 and 3.5 kN/mm$^2$, the residual shrinkage in boiling water is between 1 and 2.5%, the orientation index of the crystalline zones is between 74 and 85%, the orientation index of the mesomorphic zones is between 10 and 20%, and the orientation index of the amorphous zones is between 10 and 20%.

The present invention also relates to a process for the production of these yarns and fibers by spinning from solution in a manner which is in itself known, stretching the filaments in boiling water in a ratio of between 3 and 6 X, continuous stabilisation under tension at a temperature between 105° and 130° C., in the presence of steam under pressure, for 1 to 3 seconds, and then shrinkage at a temperature between 98° and 130° C. in an aqueous fluid medium.

In the present application, the term "polyvinyl chloride" is understood as meaning vinyl chloride homopolymer, or copolymers containing at least 85% of vinyl chloride copolymerised with compounds containing an ethylenic double bond, and having a glass transition temperature of between 65° and 85° C. Amongst these copolymerisable compounds containing an ethylenic double bond may be mentioned vinyl acetate, vinyl esters and methacrylic acid esters, acrylonitrile, and vinyl compounds containing groups which are capable of improving the suitability of the yarns and fibers for dyeing, with regard to acid and basic dyestuffs.

The polyvinyl chloride such as defined above is most commonly prepared in the least expensive way by the techniques of bulk polymerisation, suspension polymerisation, or emulsion polymerisation at temperatures above 0° C. and more generally between 20° and 60° C. These conventional types of polymerisation procedures give a polymer consisting predominately of the atactic isomeric form, that is to say a polymer in which the majority of the chlorine atoms and the hydrogen atoms are located randomly on both sides of the chain constituting the backbone of the polymer molecule. Atactic polyvinyl chloride and the products in which this is the main constituent are of a normally non-crystallisable nature, whereas the polymers of the syndiotactic type, such as described in the prior art (French Application No. 2,161,084) are considered to be crystallisable.

Surprisingly, yarns and fibers based on predominantly atactic polyvinyl chloride have been found which consist, in addition to the amorphous zones, of a significant proportion of crystallisable or mesomorphic zones, and of crystalline zones, the orientation index of these three zones remaining, even after shrinkage of the yarns and fibers in an aqueous fluid medium at between 98° to 130° C., at a sufficient level for the yarns and fibers thus obtained to possess substantially improved mechanical properties which are essentially similar to those of the yarns derived from polyvinyl chloride post-chlorinated polyvinyl chloride mixtures. Furthermore, the crystalline zone, which essentially retains the same level of orientation, consists of larger and more perfect crystals.

The orientation index of the crystalline phases, measured by an X-ray photographic method with densitometry of the films, after shrinkage of the yarns and fibers in boiling water, is at least 70% and more generally between 74 and 85%; the orientation index of the mesomorphic phases, measured by infra-red dichroism, is more than 8% and generally between 10 and 20%; and the orientation index of the amorphous zones is more than 5% and preferably between 10 and 20%. The indices of the mesomorphic and amorphous zones are greater than those of the predominantly atactic polyvinyl chloride fibers known hitherto.

The orientation of the crystalline zones is measured by X-ray diffraction. To do this, the photographic method is used with microdensitometry of the films obtained. An orientation index in Natta's orthorhombic structure is measured in the following manner.

The orientation index is calculated from the azimuthal orientation of the 110 interference by measuring its width at half-height, $\beta$, expressed in degrees of angle by the formula:

$$I = \left(\frac{180 - \beta}{180}\right) \times 100$$

The orientation of the amorphous and mesomorphic phases can be determined using infra-red spectrography by measuring the dichroic ratio D for defined wavelengths:

$$D = \frac{A\,\|}{A\perp}$$

where

A $\|$ is the optical density obtained in light polarised parallel to the axis of the fiber, and A $\perp$ is the optical density obtained in light polarised perpendicularly to the axis of the fiber.

The ratio $F=(D-1)/(D+2)$ is then calculated, which is related to the orientation either of the amorphous zones, or of the crystallisable zones, depending on the wavelengths in question.

a. Amorphous orientation

The amorphous syndiotactic units ($\alpha$) and the amorphous isotactic units ($1-\alpha$) are taken into account; $\alpha$ is the syndiotacticity of the product, measured on the polyvinyl chloride powder, and is about 0.55 for the polymers obtained at a polymerization temperature above 0° C.

The wavelength $\lambda$ at which a characteristic absorption of the amorhous syndiotactic units is observed is such that $1/\lambda=613\ cm^{-1}$, and the wavelength at which the characteristic absorption of the amorphous isotatic units is observed is such that $1/\lambda=690\ cm^{-1}$.

$f(\theta)$ depends on the geometry of the vibration in question and is calculated.

The orientation of the amorphous zones is obtained by balancing the orientations of the isotactic and syndiotactic units:

$$\text{orientation} = \left(\frac{F\,613\ cm^{-1}}{f(\theta)613\ cm^{-1}}\right)\alpha + \left(\frac{F\,690\ cm^{-1}}{f(\theta)690\ cm^{-1}}\right)(1-\alpha)$$

b. Crystallisable orientation

The absorption is carried out at a wavelength such that $1/\lambda=639\ cm^{-1}$, by a process similar to the amorphous orientation; this gives:

$$\text{orientation} = \frac{F\,639\ cm^{-1}}{f(\theta)639\ cm^{-1}}$$

Likewise, the modulus of elasticity is higher than that of the yarns and fibers derived from the polyvinyl chloride normally used, whilst the residual shrinkage in boiling water is less than 3% and preferably less than 2%.

Furthermore, the fibers according to the present invention also possess substantially improved elongation and tensile strength values which are at least equal to those of the fibers derived from mixtures of polyvinyl chloride and post-chlorinated polyvinyl chloride. Their tensile strength is generally at least 16 cN/tex and can be as much as 20 or 21 cN/tex or even more, and their elongation is between 50 and 90%. Unexpectedly, they also possess a much better resistance to fibrillation, measured by the flex-abrasion index (FAI), than the standard atactic polyvinyl chloride fibers.

In the examples, the flex-abrasion index is measured in the following manner:

The breaking strength of single fibers stretched over a steel wire at a bending angle of 110° C., and actuated with a reciprocating movement, is determined; the flex-abrasion index (or FAI) is equal to the number of cycles before breakage. Each value is an average of 25 measurements. (The apparatus comprises 25 positions each equipped with a breakage-detecting device with an independent counter.)

The yarns and fibers according to the present invention can be obtained in accordance with any known process, for example by spinning from solution in accordance with a dry or wet process.

For wet spinning, it is possible to use solutions in known solvents or solvent mixtures, such as tetrahydrofuran or tetrahydrofuran/acetone mixtures. For dry spinning, the solvents which are most widely used commercially are mixtures of benzene and acetone or of carbon disulphide and acetone in approprate proportions.

In a wet spinning process, the filaments are coagulated in a bath which is a non-solvent for the polymer but is miscible with the solvent, whereas in the dry spinning process, the solvent is evaporated off by means of hot air and generally recovered.

The concentration of polymer in the solutions is of the order of 20–30% by weight in the dry spinning process and only of the order of 10–20% by weight in wet spinning. The solutions are preferably filtered before spinning, in order to remove any particules of gel or dirt which are capable of obstructing the spinneret orifices.

After spinning, which is preferably carried out by a dry process, the filaments are stretched, in order to give them a molecular orientation and to improve their mechanical characteristics, in a ratio of between 3 and 6 X. Preferably, the stretching of the filaments according to the present invention comprises pre-heating, for example in water, at temperatures between 60° and 100° C. and more generally between 75° and 90° C. A practical method consists in using a heated water-bath. The actual stretching can be carried out in one or two stages, but it is preferred to raise the temperature of the filaments progressively by pre-heating, pre-stretching, for example in a bath in which the water can be kept at between 75° and 95° C., and then continuous stretching at a temperature slightly above that of the pre-stretching, preferably at between 85° and 100° C., the overall stretching ratio being of the order of 3 to 6 X and preferably of 3.5 to 5. In order to be able to obtain an overall stretching ratio of 6, it is easier to limit the stretching of the filaments just downstream of the spinneret, by adjusting the speed of the take-up rollers.

The filaments stretched in this way then undergo stabilisation unit tension, in order to prevent any shrinkage, in the presence of steam under pressure at a temperature between 105° and 130° C. and preferably between 110° and 120° C., for from one to three seconds.

After stabilisation, they are subjected, preferably continuously, to free shrinkage, which can be carried out in boiling water for a variable period of time, for example at least 10 minutes and generally 10 to 20 minutes or even longer, or in saturated steam, for example by passage through a nozzle such as described in French Patent No. 83,329/1,289,491.

In a nozzle of this type, the filaments are treated with saturated steam at a temperature between 105° and 130° C. and are simultaneously shrunk and crimped, which permits a better subsequent textile workability. Likewise, in the case where the shrinkage is carried out in boiling water, this is preferably preceded by mechanical crimping in accordance with any known process, for the same purpose of improving the subsequent workability.

A process of this type can be carried out entirely continuously from the stretching stage up to the shrinking stage, which permits easy production on an industrial scale and has a substantial economic advantage.

The polymers in solution, spun in accordance with the present inventions, may contain the usual additives such as stabilisers, fluorescent brighteners, pigments, dyestuffs and plasticisers, which are capable of improving at least some of their properties, such as color, dyeing affinity, heat stability, electrical resistivity, and the like.

A process of this type produces filaments with better characteristics than those of yarns based on ordinary polyvinyl chloride, as obtained hitherto. It makes it possible to obtain, at an advantageous cost, filaments which are capable of undergoing all the appropriate textile operations for their finishing and of being used, by themselves or blended with other yarns, for the production of woven fabrics, knitted farics, non-woven articles, and the like, which can undergo the usual washing and drycleaning treatments under appropriate conditions, without subsequent shrinkage.

The examples which follow, in which the parts are by weight, are given by way of further indication, but do not limit the invention.

EXAMPLE 1

A solution of predominantly atactic polyvinyl chloride (AFNOR index: 120; chlorine content: 56.5%) in a 50/50 by volume solvent mixture of carbon disulphide and acetone, with a polymer concentration of 28%, is prepared. The solution is filtered and, whilst being kept at 70° C., is spun through a spinneret of diameter 156 mm, possessing 908 orifices each of diameter 0.06 mm, into a dry-spinning cell permitting the continuous recovery of the solvent mixture, such as described in French Patent No. 913,927.

The filaments are subsequently pre-heated in a water-bath kept at 80° C., then stretched a first time at a ratio of 3.34 X in a water-bath also kept at 80° C., and then stretched again in a second water-bath, kept at 97° C., at a ratio of 1.34 X (total stretching ratio 4.45 X).

The filaments are then stabilised continuously under tension in a tube containing saturated steam under pressure at 105° C., the input and output speeds of the filaments being strictly identical and their residence time being two seconds.

The filaments then undergo free shrinkage in boiling water for 20 minutes.

The filaments thus obtained possess the characteristics given in Table 1 below.

EXAMPLE 2

Example 1 is repeated in all respects, except that the stabilisation temperature in the presence of saturated steam is kept at 110° C.

The filaments obtained possess the characteristics given in Table 1 below.

EXAMPLE 3

Example 1 is repeated, modifying only the stabilisation temperature of the filaments in the tube, which is 120° C.

The characteristics of the filaments thus obtained are grouped together in Table 1 below.

TABLE 1

| | Example 1 | Example 2 | Example 3 |
|---|---|---|---|
| Orientation index, % | | | |
| crystalline zone | 74 | 76 | 78 |
| mesomorphic zone | 14 | 17 | 14 |
| amorphous zone | 11 | 15 | 12 |
| Modulus of elasticity, kN/mm$^2$ | 2.5 | 2.5 | 3.05 |
| Residual shrinkage in boiling water, % | 2.5 | 2 | 2.5 |
| Gauge per strand in dtex | 2.78 | 2.64 | 2.52 |
| Tensile strength, cN/tex | 17.1 | 18.4 | 21.4 |
| Elongation, % | 80.9 | 77.3 | 63.4 |
| Flex-abrasion index | 1,861 | 2,218 | 2,197 |

EXAMPLE 4

A solution identical to that described in Example 1 is prepared and is spun in the same manner through a spinneret possessing 908 orifices each of diamter 0.06 mm, into a dry-spinning cell.

The filaments are subsequently pre-heated in a water-bath kept at 80° C., and then undergo a first stretching, in a water-bath kept at 81° C., at a ratio of 3.30 X, and then a second stretching in a bath kept at 98° C., at a ratio of 1.15 X, so as to obtain a total stretching ratio of 3.8 X.

The filaments pass continuously through a tube in which they are stabilised under tension at a temperature of 105° C. for two seconds, in the presence of steam under pressure, the input and output speed in the tube being approximately equal. They are then left to shrink freely in a nozzle such a described in French Patent No. 83,329/1,289,491, in the presence of injected saturated steam at an average temperature of 120° C., in which they are also crimped. They possess the characteristics indicated in Table 2 below.

EXAMPLE 5

The procedure of Example 4 is followed, except that the stabilisation stage is carried out at 110° C., in the presence of steam under pressure.

The filaments obtained after shrinkage in boiling water for 20 minutes possess the characteristics given in Table 2 below.

By way of comparison, control filaments were spun under the conditions of Example 4, but stretched in a single stage, at a ratio of 3.8 X, in a water-bath kept at 98° C., and then stabilised in a boiling water-bath at 98° C., under tension, for 10 seconds, before being shrunk and crimped in the nozzle described in French Patent No. 83,329/1,289,491. They possess the following characteristics:

TABLE 2

| | Example 4 | Example 5 | Control |
|---|---|---|---|
| Orientation factor, % | | | |
| crystalline zone | 80 | 80 | 76 |

TABLE 2-continued

| | Example 4 | Example 5 | Control |
|---|---|---|---|
| mesomorphic zone | 8.5 | 19 | 3 |
| amorphous zone | 14 | 18 | 3 |
| Modulus of elasticity, kN/mm$^2$ | 2.3 | 3.4 | 1.3 |
| Residual shrinkage in boiling water, % | 2 | 1.5 | 1.5 |
| Gauge per strand in dtex | 3.07 | 2.98 | 3.8 |
| Tensile strength, cN/tex | 16.7 | 17.6 | 15.5 |
| Elongation, % | 90 | 84.6 | 98.5 |
| Flex-abrasion index | 1,791 | 1,900 | 911 |

In the above examples, the measurements of the tensile strength are carried out with a known apparatus trade named "Instron": the maximum force supported by a sample is measured and the ratio force/gauge is calculated, the force being measured with a constant elongation gradient.

What is claimed is:

1. A process for the production of a filament, yarn or a fiber consisting essentially of atactic polyvinyl chloride and having the following characteristics;

a residual shrinkage in boiling water of less than 3%, a modulus of elasticity which is greater than or equal to 2 kN/mm$^2$, an orientation index of the crystalline zones which is greater than or equal to 70%, an orientation index of the mesomorphic zones which is greater than or equal to 8%, and an orientation index of the amorphous zones which is greater than or equal to 5%, said process being characterized in that, after dry spinning from a solution consisting essentially of atactic polyvinyl chloride the filaments are continuously stretched in boiling water at a ratio of between 3 and 6X, stabilised continuously under tension at a temperature between 105° and 130° C., in the presence of steam under pressure, for 1 to 3 seconds, and then continuously shrunk in an aqueous fluid medium at a temperature between 98° and 130° C.

2. A process as defined in claim 1, characterised in that the stretching stage comprises:

pre-heating of the filaments, pre-stretching of the filaments at a temperature between 75° and 95° C., and a second stretching stage at a temperature between 85° and 100° C.

3. A process as defined in claim 1, characterised in that the stabilisation stage is carried out at a temperature between 110° and 120° C.

4. A process as defined in claim 1, characterised in that the shrinkage is carried out in boiling water for at least 20 minutes.

5. A process as defined in claim 1, characterised in that the shrinkage is carried out in the presence of saturated steam at a temperature between 110° and 130° C.

6. A process as defined in claim 1, characterised in that the yarns undergo crimping after the stabilisation stage.

* * * * *